US005996465A

United States Patent [19]

Morikawa et al.

[11] Patent Number: 5,996,465

[45] Date of Patent: Dec. 7, 1999

[54] OIL PRESSURE DEVICE

[75] Inventors: Sumio Morikawa; Nobuyuki Zakohji, both of Osaka, Japan

[73] Assignee: Oyodo Komatsu Co., Ltd., Japan

[21] Appl. No.: 09/004,246

[22] Filed: Jan. 8, 1998

[30] Foreign Application Priority Data

Mar. 24, 1997 [JP] Japan ..... 9-069950

[51] Int. Cl.[6] ..... F15B 11/08

[52] U.S. Cl. ..... 91/420; 91/435; 91/436; 91/458

[58] Field of Search ..... 91/420, 435, 436, 91/458, 461

[56] References Cited

U.S. PATENT DOCUMENTS

| | | | |
|---|---|---|---|
| 4,216,702 | 8/1980 | Brundidge et al. | 91/436 |
| 4,836,088 | 6/1989 | Seabaugh | 91/436 |
| 5,065,664 | 11/1991 | Ohta et al. | 91/420 |
| 5,263,400 | 11/1993 | Huesser | 91/420 |

FOREIGN PATENT DOCUMENTS

| | | | |
|---|---|---|---|
| 0043079 | 4/1977 | Japan | 91/420 |

*Primary Examiner*—Hoang Nguyen
*Attorney, Agent, or Firm*—Morrison Law Firm

[57] ABSTRACT

An oil-pressure cylinder in a crushing device is connected to a crushing jaw via a pivot shaft so that the crushing jaw can open and close. The extension of oil-pressure cylinder causes the crushing jaw to close and crush the object to be crushed. Oil-pressure cylinder has a piston with a greater pressure-receiving area on the head side than on the rod side. An acceleration valve serves to switch the extension/retraction operations of the oil-pressure cylinder. During a rod unloaded interval, beginning when the crushing jaw starts to close and ending when the crushing jaw comes into contact with the object to be crushed, the acceleration valve makes communication between a head-side port and a rod-side port in the cylinder continuous, while the oil path from the rod side to a tank is blocked. The oil from the rod side is made to flow to the head side. This speeds up the movement of the rod in the closing operation during the unloaded interval before the crushing jaw comes into contact with the object being held on a fixed jaw at which time communication of the head-side oil-port with the rod-side oil port is interrupted.

1 Claim, 6 Drawing Sheets

FIG. 6(a)
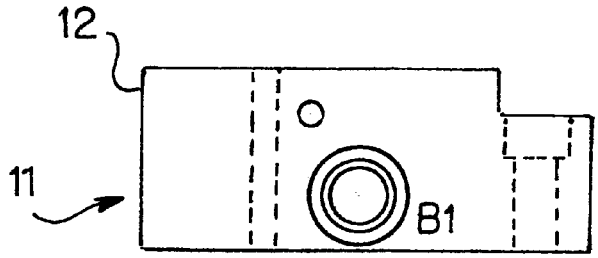
FIG. 6(b)
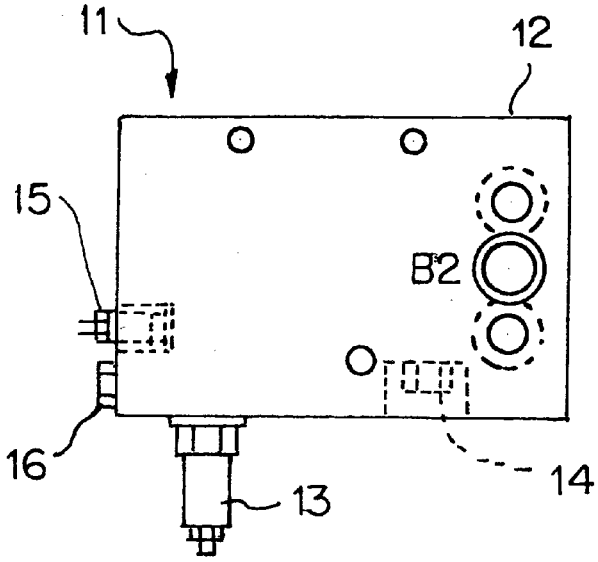
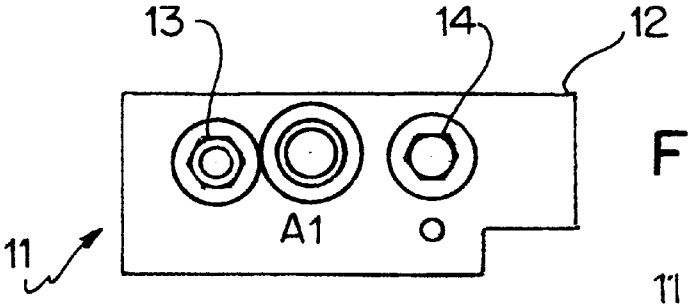
FIG. 6(c)
FIG. 6(d)
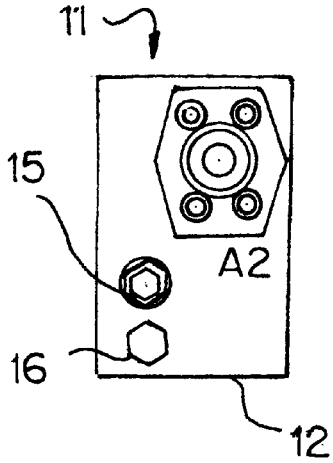

OIL PRESSURE DEVICE

BACKGROUND OF THE INVENTION

The present invention relates to an oil-pressure device. More specifically, the present invention relates to an oil-pressure device which operates with an oil-pressure cylinder unit to actuate a working device which performs prescribed operations on objects such working device being, for example, a crusher used for dismantling concrete buildings.

Referring to FIGS. 7 and 8, a crusher as shown in the drawings is generally used at sites where a concrete building is to be demolished in order to crush or cut concrete pieces, steelwork, and the like. This crusher comprises a movable upper jaw 2, driven by an oil-pressure operated cylinder unit 1, the cylinder unit 1 having a cylinder C in which is carried rod R to one end of which is attached piston 17 slidable in the cylinder, extension/retraction movement of the rod in the cylinder being effected with oil pressure acting on opposite faces of piston 17.

The cylinder unit 1 is attached at an end via a pivot shaft 5 to a fixed lower jaw 3. At an opposite cylinder end, the cylinder rod R is attached by pivot shaft 6 to upper movable jaw 2. The fixed lower jaw 3 is attached to an end of a power shovel boom or similar unit. Extension/retraction of the cylinder rod R in cylinder C, effects pivoting of upper jaw 2, which is pivoted to the lower jaw with pivot 4, between closed and open positions of same in respect to the fixed jaw 3.

When the crusher is used to crush a piece of concrete or the like, the retraction of cylinder rod R causes movable upper jaw 2 to open wide. A piece of concrete is then scooped onto fixed lower jaw 3. Then, the extension of cylinder rod R causes movable upper jaw 2 to close against the concrete piece, and the oil-pressure force effects a further closing movement of jaw 2 against the concrete piece and crushing it.

In the prior art crusher described above, when fixed lower jaw 3 and movable upper jaw 2 are used to crush pieces of concrete and the like, the opening of movable upper jaw 2 is achieved by retracting cylinder rod R. Therefore, the amount of oil needed for retraction is decreased by the volume of the rod, and the opening operation for movable upper jaw 2 is relatively fast. In contrast, once movable upper jaw 2 has been opened, cylinder rod R is extended during an interval in which no load is applied, from the beginning of the closing operation of movable upper jaw 2 to its contact with the piece of concrete. A large amount of oil is needed to extend cylinder rod R, and although the closing force of movable upper jaw 2 is strong, the speed at which this occurs is very slow. Thus, it has been extremely difficult to speed up operations.

OBJECTS AND SUMMARY OF THE INVENTION

An object of the present invention is to overcome the problems of the prior art described above.

A further object of the present invention is to shorten the time it takes for crushing operations to begin by speeding up the closing motion of the movable upper jaw during the unloaded interval, from when the movable upper jaw starts to close to when the jaw comes into contact with the piece of concrete.

The present invention relates to an oil-pressure device performing prescribed operations on an object by extending an oil-pressure cylinder rod as an actuator to operate a working device. The present invention comprises an acceleration valve that switches between extension and retraction operations of the cylinder rod, the piston carried by the rod having a piston head-side pressure-receiving area greater than a rod-side pressure-receiving area. During an unloaded interval, which begins when the actuator starts operating and ends when the actuated working device comes into contact with the object to be processed due to the extension of the oil-pressure cylinder rod, the acceleration valve operates to make communication between the piston head-side port and the cylinder rod-side port continuous and the acceleration valve causes oil to flow from the cylinder rod side to the piston head side while blocking the oil path from the cylinder rod side to the tank. This serves to improve the speed at which operations are performed.

The actuated working device can comprise a crushing jaw for a crusher that is hinged via a pivot shaft so that it can open and close, and that can crush an object when brought to closed position.

The above, and other objects, features and advantages of the present invention will become apparent from the following description read in conjunction with the accompanying drawings, in which like reference numerals designate the same elements.

BRIEF DESCRIPTION OF THE DRAWINGS

FIG. 6 (*a*) is a rear-view drawing showing the manifold of the acceleration valve.

FIG. 6 (*b*) is a plan drawing of FIG. 6 (*a*).

FIG. 6 (*c*) is a front-view drawing of FIG. 6 (*b*).

FIG. 6 (*d*) is a side-view drawing of FIG. 6 (*b*).

DETAILED DESCRIPTION OF THE PREFERRED EMBODIMENTS

Figure 7:
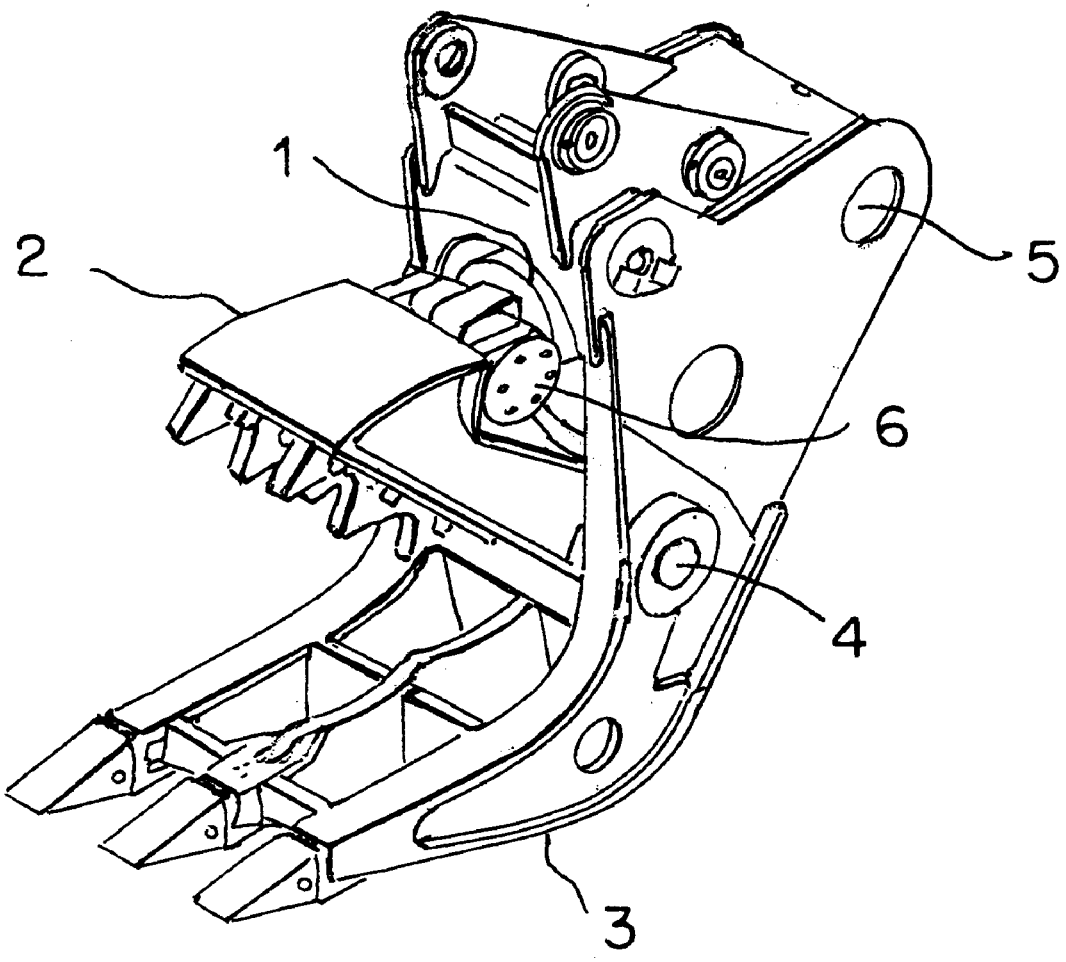
FIG. 7 PRIOR ART
FIG. 7 is a perspective drawing showing the fixed lower jaw and the movable upper jaw of the crusher.
Figure 8:
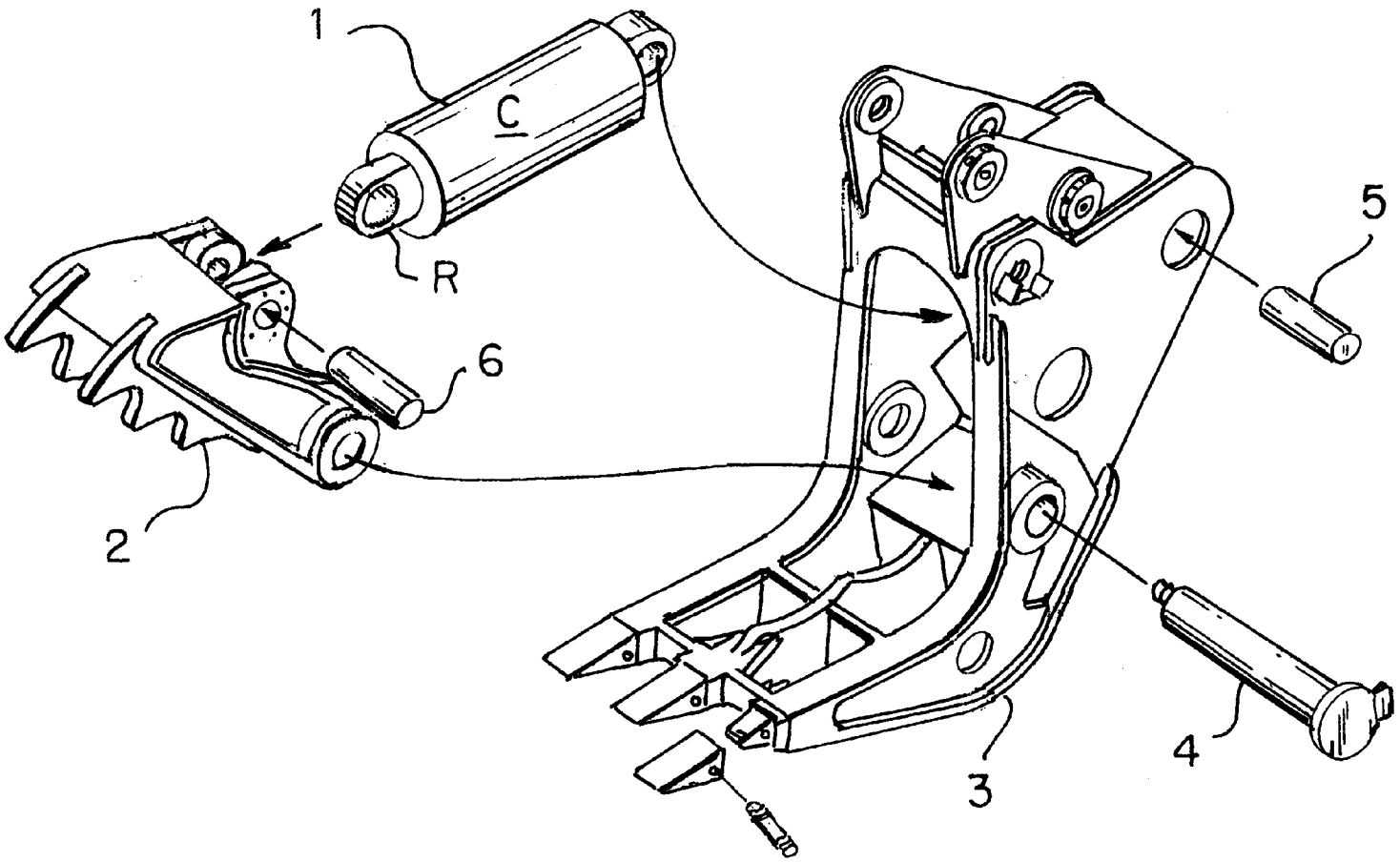
FIG. 8 PRIOR ART
FIG. 8 is an exploded perspective-view drawing of FIG. 7.

Referring to FIG. 7 and FIG. 8, the crusher and more particularly a movable jaw thereof is the working device and the cylinder unit is the movable jaw actuator, movable upper jaw 2 being actuated by the rod R of oil-pressure cylinder unit 1, the rod carrying a piston 17 as described above.

Movable upper jaw 2 is hinged to a fixed lower jaw 3 via a pivot shaft 4. Fixed lower jaw 3 is attached to the end of a boom on a power shovel or the like. The oil-pressure cylinder unit 1 is hinged at one end to lower jaw 3 via a pivot shaft 5 while at its opposite end, the cylinder rod R pivoted to movable upper jaw 2 via a pivot shaft 6.

Figure 5:
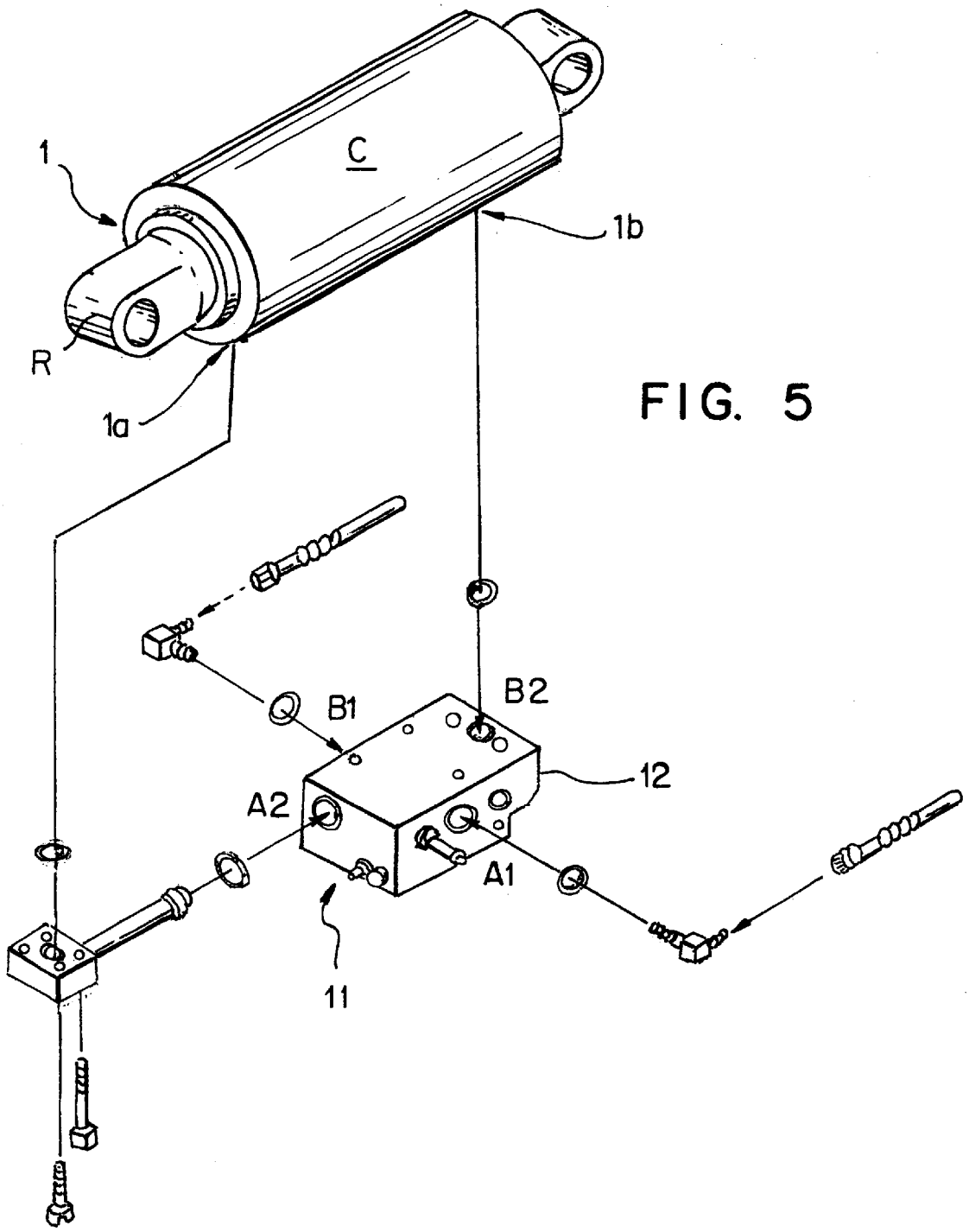
FIG. 5 is an exploded perspective-view drawing showing the oil-pressure cylinder and the acceleration valve.

The extension of cylinder rod R causes movable upper jaw 2 to close relative to fixed lower jaw 3. Conversely, when the cylinder rod is retracted, movable lower jaw 2 opens relative to fixed lower jaw 3. Referring to FIG. 5, oil-pressure cylinder 1, which via its rod R drives movable upper jaw 2, is connected to an acceleration valve 11 of the present invention. Referring to the oil-pressure circuit shown in FIG. 1, a head-side port 1*b* and a rod-side port 1*a* at the oil-pressure cylinder C are connected with acceleration valve 11 by pipe connectors B2, A2, respectively.

Figure 1:
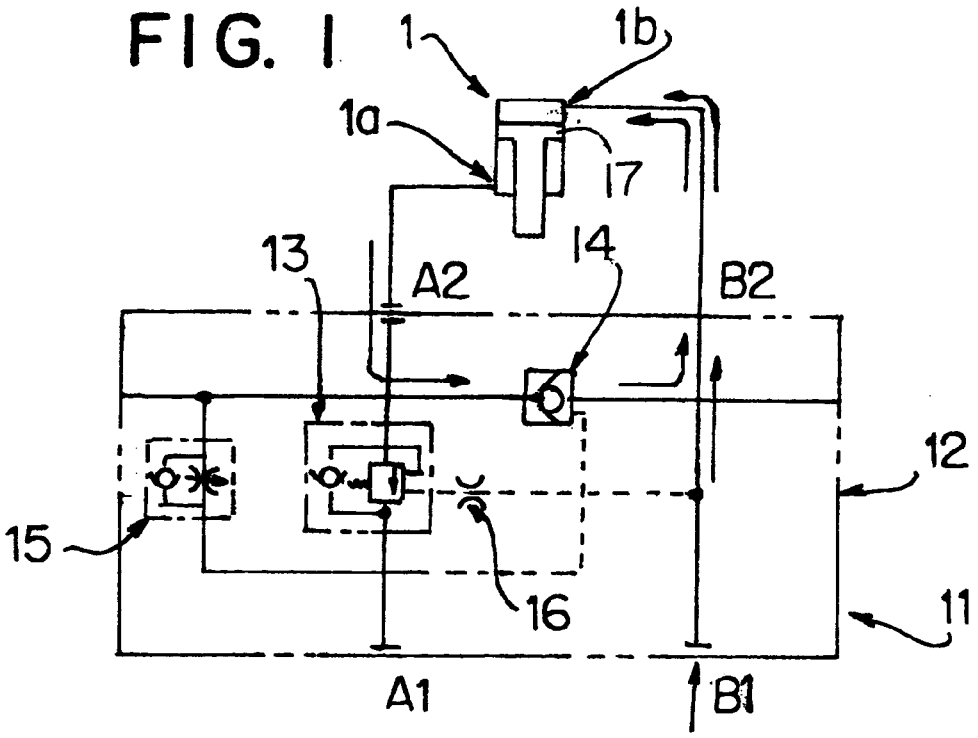
FIG. 1 is a drawing of an oil-pressure circuit showing the oil-pressure cylinder and the acceleration valve of the crusher according to the present invention and showing the state when the oil-pressure cylinder is being extended during the unloaded interval (beginning when the movable upper jaw starts to close and ending when the movable upper jaw comes into contact with the lump of concrete).
Figure 4:
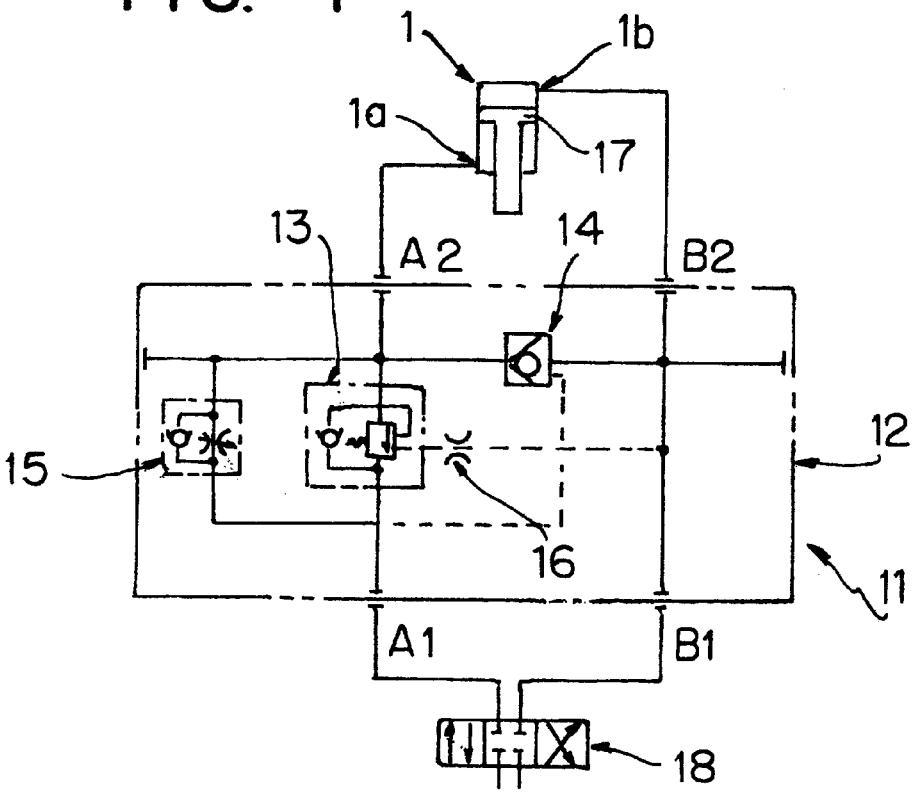
FIG. 4 is a drawing of an oil-pressure circuit when the movable upper jaw is not operating.

Pipe connectors B1, A1 connect the acceleration valve to the oil-pressure tank (not shown), an oil-pressure pump (not shown) and a direction-control valve 18 (FIG. 4). Connectors B1, A1 define oil supply/return courses as do connectors B2, A2. Referring to FIGS. 1 and 6(*a*)–6(*d*), acceleration valve 11 comprises a counter-balance valve 13, a pilot-check valve 14, and a slow-return check valve 15.

Specifically, counter-balance valve 13 is connected, within a manifold 12, between rod-side port 1*a* of oil-pressure cylinder 1 and the oil tank Also, pilot-check valve 14 is connected, within manifold 12, between rod-side port 1*a* and head-side port 1*b* of oil-pressure cylinder 1. Furthermore, slow-return check valve 15 is connected, within manifold 12, between rod-side port 1*a* of oil-pressure cylinder 1 and the oil tank. Slow-return check valve 15 is connected in parallel with counter-balance valve 13. A restrictor 16 applies a stable pilot pressure to counter-balance valve 13.

The oil-pressure circuit showings in FIGS. 1–4 are referred to for describing the opening and closing operations of movable upper jaw 2 resulting from the extension and retraction of oil-pressure cylinder 1 caused by acceleration valve 11 and as occur incident crushing of an object such as a lump of concrete.

Figure 3:
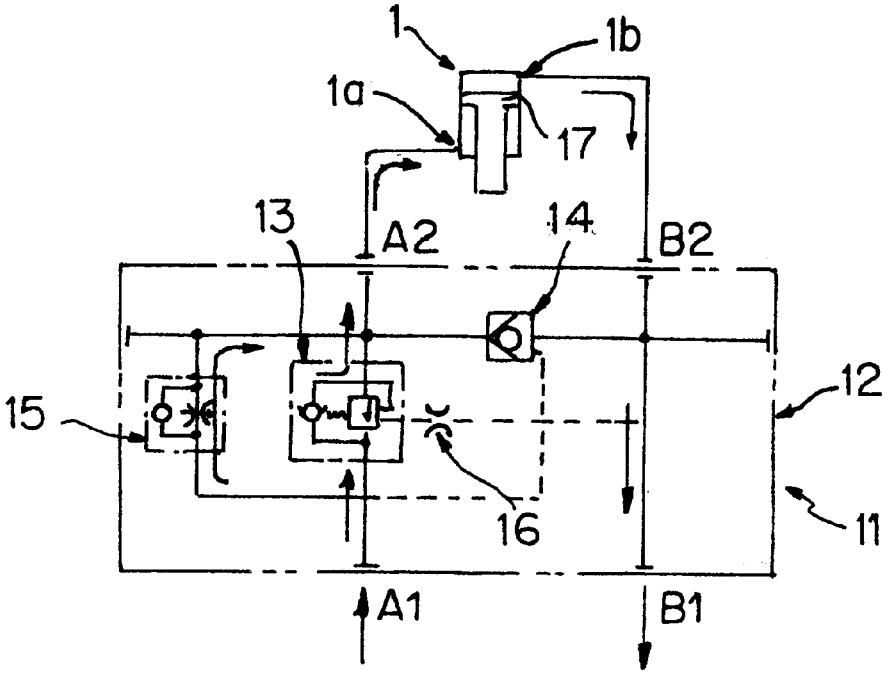
FIG. 3 is a drawing of an oil-pressure circuit showing the state when the oil-pressure cylinder rod is being retracted to open the movable upper jaw.

Referring to FIG. 3, an oil-pressure pump feeds (not shown) oil from an oil tank (not shown) through the direction-control valve 18 (FIG. 4) and from pipe connector A1 of acceleration valve 11 to rod-side port 1*a* of oil-pressure cylinder via counter balance valve 13. When this is taking place, the oil tries to divert to the head side of oil-pressure cylinder 1 via pilot-check valve 14. However, the pilot-side port area of pilot-check valve 14 is larger than the rod-side port area (by a factor of 1.8, for example). Thus, even if the oil-pressure applied to the pilot-side port of pilot check valve 14 is the same as the pressure to the rod-side port, the force that acts to close pilot-check valve 14 is greater than the force trying to open it. In this way, the closed state of the pilot-check valve 14 is maintained, and oil does not flow toward head-side port 1*b* of oil-pressure cylinder 1.

With movable upper jaw 2 opened wide, the lump of concrete, for example, having been scooped onto the fixed jaw 3 by operation of the power shovel boom, sits thereon and the closing operation of movable upper jaw 2 is begun. In this circumstance, almost no pressure is needed for the oil-pressure cylinder, and any oil pressure that is generated is low. Further, the piston 17 is positioned at an upper end of the cylinder C.

Referring to FIG. 1, the position of direction-control valve 18 is switched, and oil from the oil tank is sent by the oil-pressure pump to the head-side port 1*b* of the oil-pressure cylinder via pipe connectors B1, B2 of acceleration valve 11. No load is present during the interval be inning with the start of the closing operation of the movable upper jaw and ending with when contact is achieved with the lump of concrete. The pilot pressure applied to counter-balance valve 13 via restrictor 16 is smaller than the spring force of counter-balance valve 13. As a result, counter-balance valve 13 is kept in a closed state, and the flow path for oil from rod-side port 1*a* of oil-pressure cylinder 1 back to the oil tank is blocked.

At this point, the head-side pressure-receiving area at oil-pressure cylinder 1, i.e., the large face of piston 17 is greater than the pressure-receiving area on the rod side, i.e., the piston's opposite face. This pushes piston 17 toward the opposite end of the cylinder C (and the rod R outwardly of the cylinder), causing oil to flow from rod-side port 1*a* to head-side port 1*b* via pilot-check valve 14.

Thus, in addition to the oil sent from the oil pump to head-side port 1*b* of oil-pressure cylinder 1 via pipe connectors B1, B2, there is also oil flowing from rod-side port 1*a* of oil-pressure cylinder 1 to head-side port 1*b* via pilot-check valve 14. This increases the amount of oil at the large face of piston 17 and provides quicker extension of oil-pressure cylinder 1, allowing movable upper jaw 2 to quickly come into contact with the lump of concrete.

The oil-pressure cylinder theoretically moves piston 17 as a result of the difference between the area pushing piston 17 from the head side and the area pushing piston 17 from the rod side. Thus, it is possible to consider the thickness of piston 17 to have become equal to that of the rod. In other words, oil-pressure cylinder 1 effectively becomes temporarily thinner.

Movable upper jaw 2 then needs more force application thereto once it comes into contact with the lump of concrete, so the oil-pressure increases. If, at this point, head-side port 1*b* of oil-pressure cylinder 1 is in communication with rod-side port 1*a*, piston 17 is pushed only with an area which is, effectively, that of the rod, resulting in an insufficient force. Therefore, communication between ports 1*a*, 1*b* is disconnected. This is performed by detecting the increase in oil pressure on the head side when movable upper jaw 2 comes into contact with the concrete lump as described next.

Figure 2:
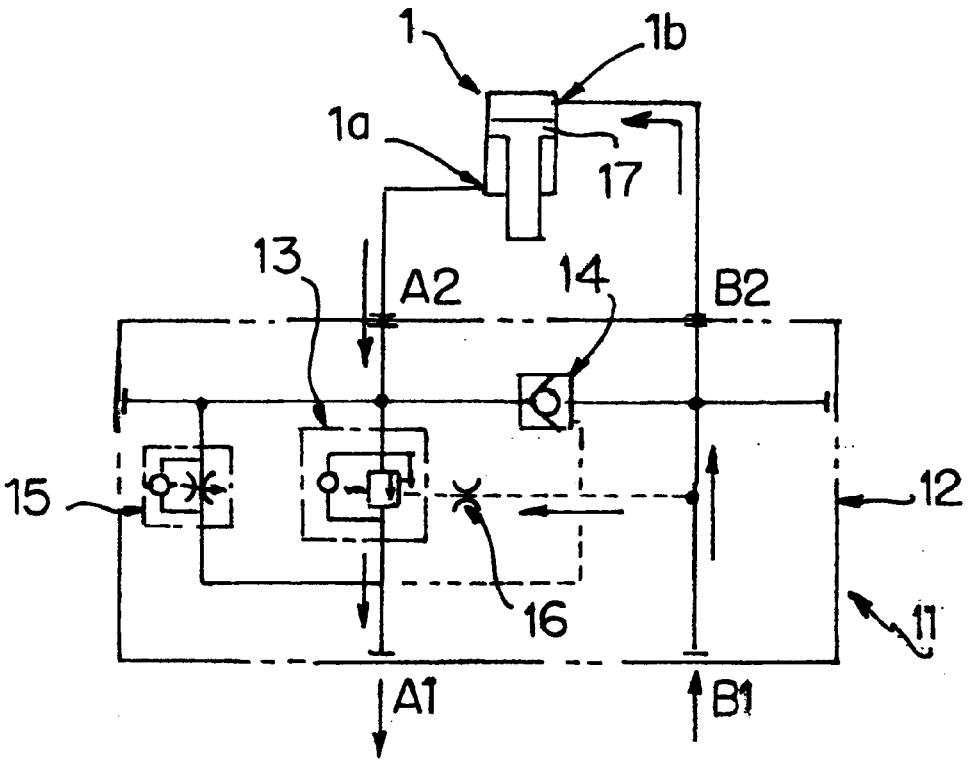
FIG. 2 is a drawing of an oil-pressure circuit showing the state during a further interval when the oil-pressure cylinder rod is being extended during the closing operation after the movable upper jaw has come into contact with the concrete lump.

Referring to FIG. 2, once movable upper jaw 2 comes into contact with the concrete lump, a load is applied to oil-pressure cylinder 1, and the pilot pressure applied to counter-balance valve 13 via restrictor 16 becomes greater than the spring force of counter-balance valve 13. As a result, counter-balance valve 13 opens, and the oil from rod-side port 1*a* of oil-pressure cylinder 1 returns to the oil tank via pipe connectors A2, A1 of acceleration valve 11. This results in a decrease in oil pressure on the rod side (smaller piston face), and a prescribed oil-pressure acts (at the larger piston face) to extend oil-pressure cylinder 1, and the lump of concrete is crushed.

Referring to FIG. 4, when a concrete lump is not being crushed, a positioning of direction control valve 18 keeps the oil within acceleration valve 11 and oil-pressure cylinder 1 from moving. However, small amounts of oil easily can leak out of direction control valve 18. When this small amount of oil leaks between direction control valve 18 and counter-balance valve 13, the pilot pressure that is acting to close pilot-heck valve at acceleration valve 11 diminishes. This causes pilot-check valve 14 to open, and the weight of movable upper jaw 2 and oil-pressure cylinder 1 causes oil to flow from rod-side port 1*a* of oil-pressure cylinder 1 to head-side port 1*b*. This makes it possible for movable upper jaw 2 to operate unpredictably.

Therefore, slow-return check valve 15 replenishes oil to the rod side of oil-pressure cylinder 1 by the same amount as the leakage from direction control valve 18. As a result, the rod side and the pilot side of pilot-check valve 14 are kept constantly at the same pressure, and this equal pressure prevents pilot check valve 14 from opening when the pilot-side port diameter is greater by a factor of 1.8. Thus, movable upper jaw 2 is prevented from operating unpredictably as a result of oil-pressure cylinder 1.

Having described preferred embodiments of the invention with reference to the accompanying drawings, it is to be understood that the invention is not limited to those precise embodiments, and that various changes and modifications may be effected therein by one skilled in the art without departing from the scope or spirit of the invention as defined in the appended claims.

In the embodiment described above, the present invention was implemented in a crushing device used to demolish concrete buildings and the like, but the present invention is not restricted to this application. The present invention can also be implemented in an oil-pressure device comprising an actuator other than a crushing jaw and used for operations such as shearing or transporting objects other than concrete lumps.

When the present invention is implemented in a crushing device, the head-side port and the rod-side port of the oil-pressure cylinder are made continuous during the interval beginning with the start of the closing operation of the crushing jaw and ending with when the crushing jaw comes into contact with the object to be crushed as a result of the extension of the oil-pressure cylinder. The oil path from the rod side to the tank is blocked, and the rod-side oil is sent to the head side. These operations are performed by an acceleration valve. Thus, the operations beginning with the start of closing operations of the crushing jaw and ending when the crushing jaw comes into contact with the object to be crushed can be sped up using simple means. The time required to begin the crushing operation is reduced, and efficiency is improved, thus making the present invention very useful.

What is claimed is:

1. In an oil-pressure device which operates with an oil-pressure cylinder unit to actuate a working device, the oil cylinder unit including a cylinder, a piston movable in the cylinder, and a rod connected at and end thereof to the piston, an opposite end of the rod being connected to the working device, the rod having extension movement outwardly from and retraction movement into the cylinder responsive to imposition of oil pressure at respective larger and smaller opposite faces of the piston, the cylinder having a head side oil port communicating with the piston larger face and a rod side oil port communicating with the piston smaller face, an acceleration valve operable to speed up extension movement of the rod during a first part of rod travel from a fully retracted position thereof wherein there is no load imposed by the working device on the rod and until a loading is imposed by the working device on the rod, the acceleration valve including a counter-balance valve and a pilot check valve, a pilot pressure applied to the counter-balance valve when a pressure flow of oil is supplied to the head-side oil port acting on the counter-balance valve being insufficient to cause the counter balance valve to open from its closed condition blocking a return flow of oil from the smaller piston face side of the cylinder to an oil tank return course whereby the rod side oil port of the cylinder is maintained in communication with the head-side oil port so that the return flow of oil is diverted to the head-side oil-port increasing the oil amount at the piston large face and in consequence increase in the speed at which the rod extends at least until the working device imposes a load on the rod, on imposition of a load on the rod, pilot pressure on the counter-balance valve increases to cause opening of the counter-balance valve whereby the rod side oil port of the cylinder is placed in communication with the oil tank return course so that oil from the rod side of the cylinder can flow to said return course, and a slow return check valve connected between said rod side oil port and the oil tank return course and being in parallel connection with the counter-balance valve, said slow return check valve in absence of a load being imposed on said rod being operable to replenish oil to the rod side oil port by such an amount as leaks from a direction control valve to keep a rod side and a pilot side of the pilot check valve at the same pressure to prevent the pilot check valve from opening and therewith allowing unpredictable movement of the working device.

* * * * *